US006595247B1

(12) United States Patent
Landy et al.

(10) Patent No.: US 6,595,247 B1
(45) Date of Patent: Jul. 22, 2003

(54) SUSPICIOUS OBJECT CONTAINER AND METHOD

(76) Inventors: Jerome J. Landy, 9175 Hammock Lake Dr., Coral Gables, FL (US) 33158; Keith E. Landy, 347 N. Beach St., Ormond Beach, FL (US) 32174

( * ) Notice: Subject to any disclaimer, the term of this patent is extended or adjusted under 35 U.S.C. 154(b) by 0 days.

(21) Appl. No.: 10/078,032

(22) Filed: Feb. 19, 2002

(51) Int. Cl.[7] ..... B65B 1/04

(52) U.S. Cl. ..... 141/97; 141/98; 141/114; 312/1; 454/56

(58) Field of Search ..... 454/49, 56–62, 454/63–65; 312/1; 141/98, 97, 114

(56) References Cited

U.S. PATENT DOCUMENTS 4,911,191 A * 3/1990 Bain ..... 134/200
RE33,810 E * 2/1992 Strieter ..... 134/99.1
5,685,771 A * 11/1997 Kleppen ..... 454/56
5,735,321 A * 4/1998 Martyn et al. ..... 141/383

* cited by examiner

*Primary Examiner*—Steven O. Douglas
(74) *Attorney, Agent, or Firm*—Jack E. Dominik

(57) ABSTRACT

A kit which can be ready to position in a containment fashion over a suspicious object or target. A chamber is formed having a surrounding wall with a mating top. At the lower portion of the wall a substrate engaging means is provided with lateral edges which are stabilized for securement to the surface on which the target lies while the chamber is brought into its full configuration by wall support means. At the upper portion of the top provision is made for handling sleeves and ports. Examination, sampling and decontamination can be carried out without disturbing the target while protecting the environment, evidence and people. The target can be encapsulated in the chamber by means of tightening a drawstring. This progressively brings the lower portion in the flange into and under the bottom of the contained item to thereby fully envelop the target. An explosive shield can be simultaneously employed.

9 Claims, 6 Drawing Sheets

SUSPICIOUS OBJECT CONTAINER AND METHOD

FIELD OF THE INVENTION

The present invention relates to a rapid containment assembly which is optimally deployed in a rapid containment kit and method for dealing with suspicious objects or packages which may be weapons of mass destruction (WMD) and other potentially harmful agents. The subject addresses various aspects of containment, identification, collection of evidence, decontamination and transportation of objects or substances for germ or chemical warfare as well as explosives and incendiary devices and other hazardous materials.

BACKGROUND OF THE INVENTION

WMD agents, primarily biological and chemical military warfare agents, which have traditionally been developed for battlefield conditions, are now being used in smaller quantities and sizes for terrorist activities. Likely agents would include anthrax, plague, nerve gas and the like. Other terrorist weapons relate to explosive and incendiary devices which, depending on their placement, could be incredibly destructive. These substances can be contained in relatively small containers and packages, such as back packs, the common 1 to 2 gallon plastic jugs or metal paint cans, briefcases and the like. Although the emphasis is on the containment of smaller objects, this invention can be used for larger items such as suitcases.

There is a pressing need to contain, identify and handle "unknown objects" left unattended in public places. Fear of the unknown has created a vast psychological and economic problem for society. Although the actual danger from WMD is real, the overwhelming number of incidents are due to carelessness, ignorance or hoaxes. Closing large buildings, airports, shopping malls, government institutions, production lines, etc. can add to hysteria and cost huge sums. The events of Sep. 11, 2001 have obviously exacerbated this situation.

Items left unattended in public places such as lunch buckets, back packs, wrapped packages, briefcases etc. have to be treated as potentially lethal. The first person to respond to this suspicious object is termed the first responder who most commonly is a security guard, a policeman, or a public works employee. The first responder that comes in contact with the suspicious object most frequently has had minimal training in how to contain the object and typically has no knowledge of how to safely identify the suspicious object or how to secure the object if needed for evidence. Often, the first responder will mishandle the suspicious object making it more difficult for the second and subsequent responder's to perform their functions. Most frequently the second responder called to the scene is a municipal fireman trained in identifying and handling hazardous materials. Usually this second responder will determine that the object is a hoax or misplaced item. If the unknown object is suspected of being a threat to the public additional responders can be called to the scene. These additional responders have specialized skills in such areas as crime scene investigation and collection of evidence and can also check the second responders findings. In the more serious incidences these additional responders are usually a state or federal agency such as the National Guard or FBI.

The rapid containment system, which can most effectively be deployed in a rapid containment kit, is designed to be easily deployed by the first responder to rapidly contain the suspicious object to protect people and the environment. Deployment of the rapid containment system by the first responder will aid the second and subsequent responders in various aspects of identification, decontamination, evidence collection and transportation. The rapid containment system can initially also be deployed by the second and any subsequent responder due to the fact that it is useful for many functions. For example, the rapid containment system aids the second responder as it isolates the unknown object from the effects of wind, air currents, rain and water, thus maintaining sample and evidence integrity for accurate identification as well as protecting people and the environment.

SUMMARY OF THE INVENTION

The present invention contemplates an assembly kit which can be transported in a backpack, yet quickly removable in a matter of minutes and be ready to position in a containment fashion over a suspicious object (hereinafter referred to as target). The invention includes a chamber desirably cylindrical with a circular top. Alternatives include rectilinear sidewalls usually of equal cross-section, such as square, hexagonal, and the like. Tapering upwardly and outwardly of the walls, whether rectilinear or curvilinear, is also contemplated. At the lower portion of the chamber a base flange is provided with lateral edges which are stabilized for securement to the surface on which the target lies while the cylindrical member is brought into its full configuration by wall support struts. Pop-up or otherwise longitudinally adjustable struts and other rapidly deployed means can be attached to and used to rigidify the chamber instead of the wall struts which are described and illustrated herein as one embodiment of this invention. At the upper portion of the top provision is made for handling sleeves. Interior of each such sleeve is a handler which can be a glove, mitten, or yet the sleeve itself as well as other configurations which permit identification, decontamination and handling of the encapsulated target if required. At the termination of the containment, the target can desirably be encapsulated in the chamber by means of tightening a drawstring located in the lower portion of the chamber. This progressively brings the lower portion in the flange into and under the bottom of the contained item to thereby fully envelop the target.

According to the method, additional means are provided whereby sample readings may be taken from the target, and also means are provided to filter as well as decontaminate, all of which are inserted into the chamber through ports. The ports are desirably placed in the upper portion.

Yet another supplemental feature of the invention looks to the provision of an explosion shield in which the side walls are an inverted frusto conical member. The sidewalls of the explosion shield are made utilizing a material such as Kevlar® or other bulletproof like material and are tapered in such a fashion to deflect upwardly any shrapnel or other explosive and to effectively spend their energy harmlessly by not extending unimpededly lately where personnel are exposed. When the container itself is made of a similar material, the container can be tapered just as the explosion shield.

The method of the invention also contemplates various steps of employing the subject assembly, and more particularly the sequencing which is desirably employed, includes the filtration of particulates and gases with HEPA and carbon filters to protect personnel and the environment from gas and particulates generated from the target as well as maintain the environment surrounding the target inside the rapid containment system in order to aid in identification of the target and to purge the interior portion of the container prior to transporting or disposing of the target.

In addition, it is a principle object of the present invention to provide a rapid containment kit which is easily stored and transported, and yet quickly and positively erected and positioned without the need to handle the target, thus providing a sense of security to the public.

A further object of the present invention is directed to such a rapid containment kit which will have a total weight of 10 lbs. or less, thus making its portability and storage by virtually everyone a realistic possibility.

Yet another and important object of the present invention is to provide a rapid containment kit which is easily identified and used by all level of responders to aid in their required tasks along with maintaining the target in its original place for subsequent responders.

Yet another and important object of the present invention is to provide a rapid containment kit which is basically disposable with a contaminated target, but is also reusable, in whole, when the target proves to be a hoax target.

Yet another and important object of the present invention is to provide a rapid containment kit which protects personnel and the environment from releases from the target which can be accentuated by wind, air currents, rain and water.

An auxiliary object of the present invent is to provide a rapid deployment kit for weapons of mass destruction and other threat which can also be converted to be used as a Class III glovebox.

A further and important object of the present invention is to provide a rapid containment kit which protects the target from wind, air currents, rain and water in order to preserve and gather evidence.

In view of the foregoing, it is a principle object of the present invention to provide a rapid containment kit which is easily employed as a safety containment glovebox for the containment of hazardous biological and chemical material.

Finally, as with all inventions, the objective is also cost effectiveness with a total material and labor cost economically gauged to the hazard involved and alternative techniques for securing the hazard.

DESCRIPTION OF THE DRAWINGS

Further objects and advantages of the present invention will become apparent as the following description of illustrative embodiments proceed, taken in conjunction with the accompanying drawings in which:

FIG. 8 shows both hands of the responder preparing the sample;

FIG. 9 illustrates how the handlers can reach all portions of the chamber and is a section taken along section line 9—9 of FIG. 8;

FIG. 10 is a further sequential illustrative view showing how one hand through one of the handlers can grasp the sample to remove it;

FIG. 11 is a sequential view of FIG. 10 illustrating the sample being inversely folded at the end of the handler for being tied off and transporting for further analysis;

FIG. 12 is comparable to that of FIGS. 10 and 11 but illustrating how the bag-out technique is employed by reversely and inversely securing the end of the handler to be tied and secured; the bag-in process is essentially the reverse of this procedure;

FIG. 13 illustrates cutting between two tie wraps sequential to that of FIG. 12 in order to seal off the end of the handler and seal off the bag containing a sample;

FIGS. 14 through 22 show various components;

FIG. 14 is a perspective view of the carrying bag;

FIG. 15 is a view of struts which are used to help form the chamber;

FIG. 16 is the chamber and top in its folded configuration prior to erection;

FIG. 18 is a instrument sampler for immediate target identification;

FIG. 19 is a bottle of a decontaminant which can be employed with the decontaminant injector shown in FIG. 20;

FIG. 21 is a vacuum air sampler 36 to be used for removing and isolating some of the interior atmosphere for target identification; and FIG. 22 is a perspective view of an explosive shield, in its folded configuration, which is optionally employed.

DESCRIPTION OF ILLUSTRATIVE EMBODIMENTS

Figure 1:
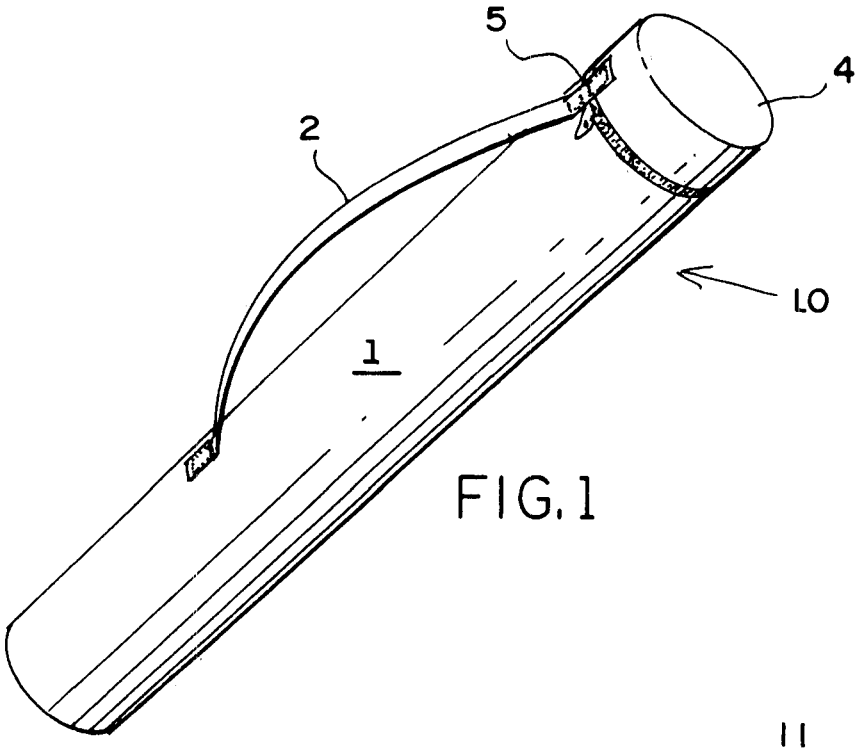
FIG. 1 is a backpack containing the rapid containment assembly kit form illustrative of the invention.

Shown in FIG. 1 is a typical rapid containment kit 10 housed in a backpack 1. Strap 2 is provided in the uninterrupted side for carrying by hand or strapping over the back. A flap member 4 is desirably positioned at one end having a securement element 5. While the backpack is not part of the invention it enhances portability and ease of storage. The invention contemplates encapsulation in such a fashion that a wide variety of backpacks, depending upon the responding organizations and their function utilizing it, can be employed with the rapid containment kit for engaging the potential suspicious object.

Figure 2:
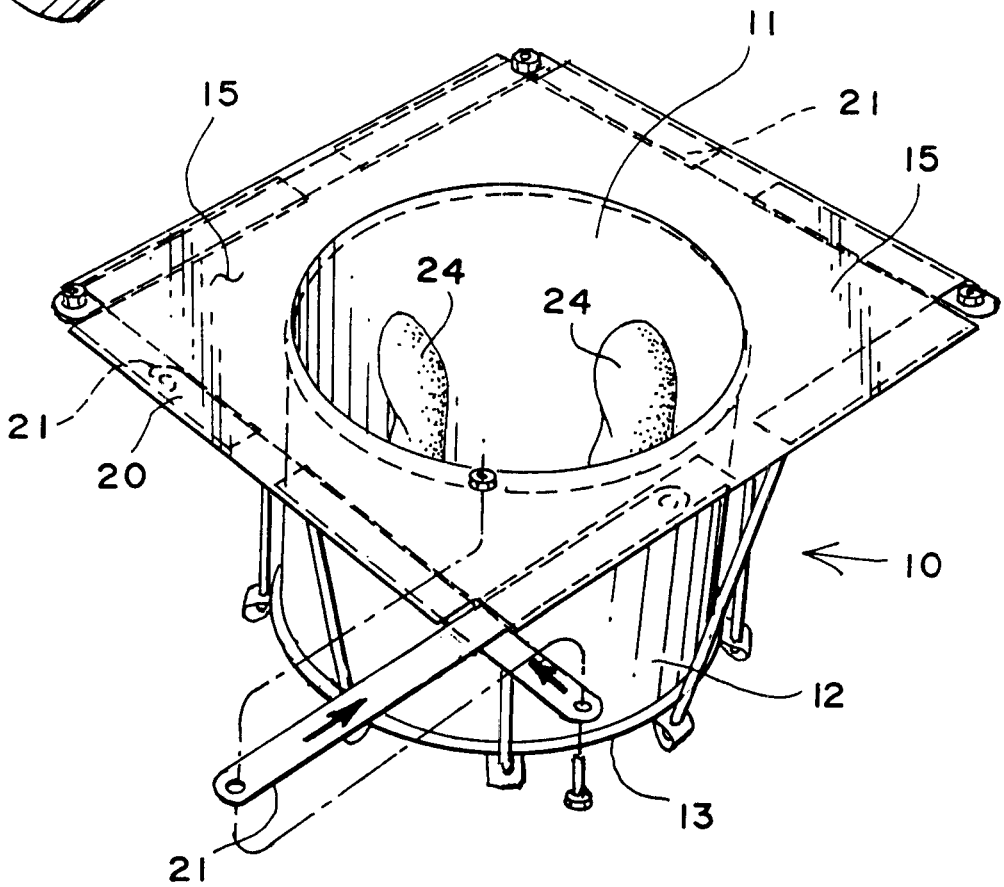
FIG. 2 is a partially diagrammatic showing of the chamber, base flange, and base flange support in the inverted configuration from that intended for encapsulating the target.

Turning now to FIG. 2, the various elements of the rapid containment kit 10, such as the cylindrical wall 12 which assists in forming a chamber 11 by means of a circular top forming hoop 13, a circular top 14, and a base flange 15 which is shown here as essentially square having four corners. The base flange 15 has in its lateral edges flange sleeves 20 which receive flange flattener elements 21.

As will be noted in FIG. 2, and elsewhere, the circular top forming hoop 13, is employed to impart the cylindrical shape to the container and upon dismantling will collapse to encapsulate the suspicious target.

Figure 3:
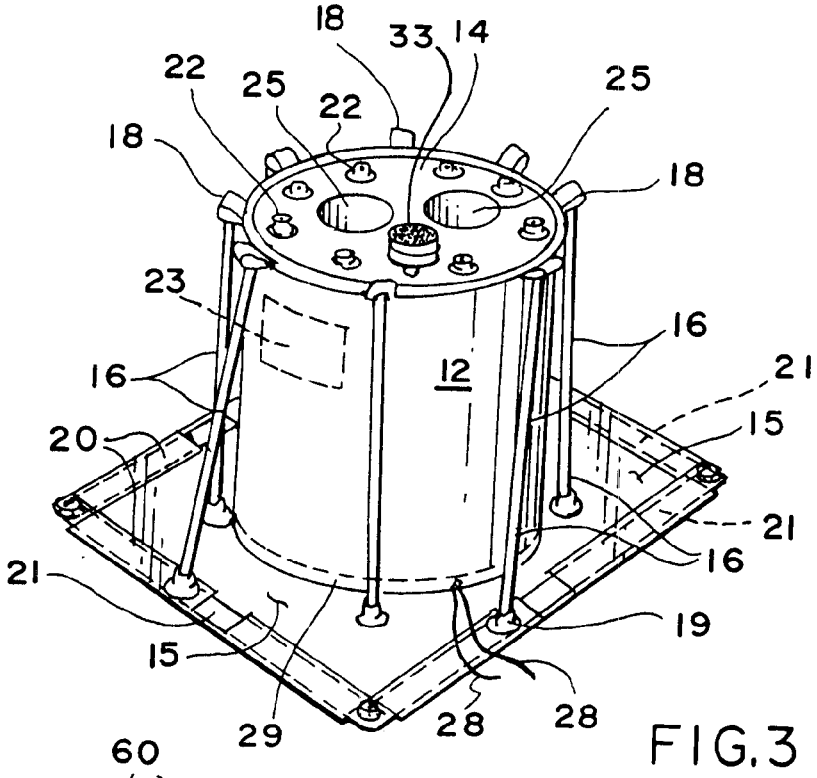
FIG. 3 is a perspective view of the assembled containment system with handlers not yet extended.

One embodiment of a containment kit in its disassembled form is shown in detail in FIGS. 14 through 22 which will be treated toward the end of this description. As shown in FIG. 3, the chamber is rendered. semi-rigid by inserting wall support struts 16 which pass through wall support tabs 18 into wall support footers 19. Ports 22 are provided on the circular top 14 for insertion of a wide variety of instrumentalities.

Figure 5:
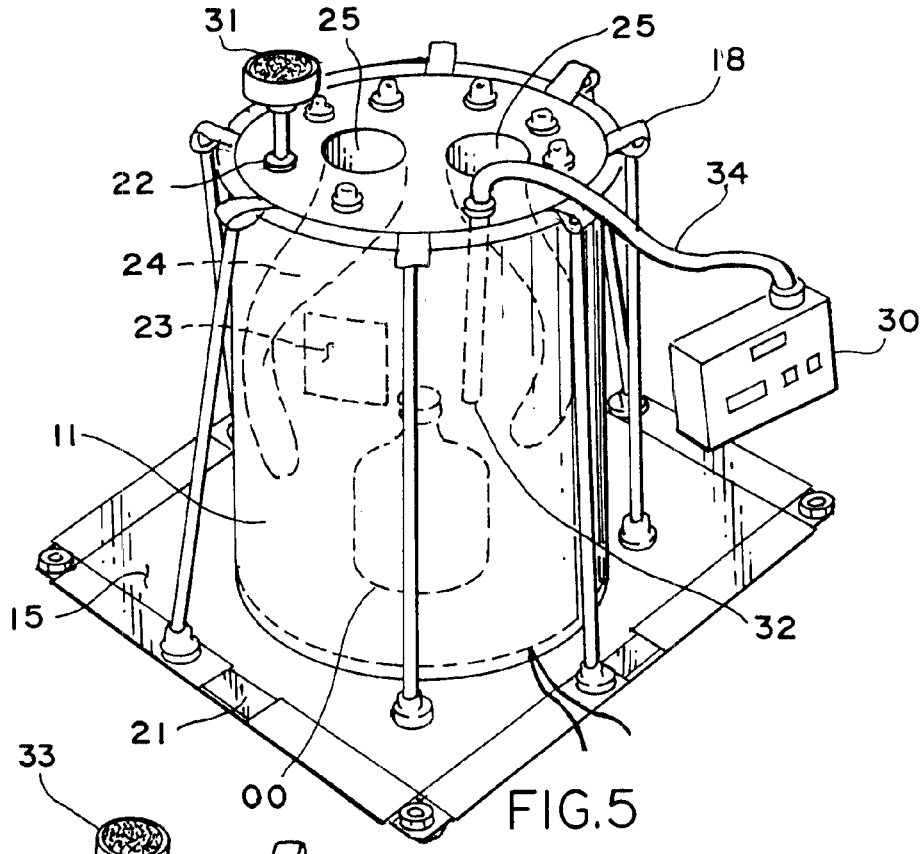
FIG. 5 is a further prospective view of the assembled containment system, a filter, an analyzer as secured to the top of the chamber and in addition showing the handler sleeve and target, in the form of a one gallon bottle, in phantom lines.

At an off-center position of the circular top 14 one or more handler sleeves 24 are provided. For ease of visualization two handlers are illustrated in these drawings. The handler which is a handler sleeve 24 desirably sealed to the circular top 14 includes a handler opening 25 into which the hand may be inserted. The handler sleeve 24 is shown in FIG. 5 as a closed tube, but it could as well be a glove, a mitten, or sleeve with glove. The initial purpose of the handler sleeve 24 is to aid in sampling and identification of the suspicious object or target X while preferably not handling the target. The secondary purpose of the handler sleeve is to permit manipulation of the target X for decontamination and to secure it when it is determined that it is safe to handle.

As to the sleeves that form the handler 24, optionally there can be a finger receiving member at the end of one such sleeve or the other such sleeve, or both. In either case the sleeve end, upon reversal, internally becomes the bag forming member which can contain a sample or item. The exterior chamber wall is desirably circular for rigidity, manufacturing and economy purposes.

Interiorly of the chamber there is desirably positioned a utensil pocket 23. This pocket contains small items needed for the bag-in bag-out procedure, ties to secure the bag ends, and any other clamping implementation and cutting materials to assist in the bag-in bag-out procedure. This pocket can be pre loaded with equipment deemed desirable by the intended responder.

Once the target X has been contained, investigation can be carried out in a safe and orderly manner. As shown in FIG. 5, a sample reader 30, which includes a sampler lead 32 at the end of the sampler line 34, passes through one of the ports 22 in the top 14 and a reading can be taken of target X. A particulate filter 31 is also provided in one of the ports 22 which allows make up air to balance the air removed by the sampler as well as provide a non-contaminated sample. Commercially available and acceptable filters prevent particulates from the chamber 11 passing outwardly attributable to any inflow occasioned by the use of the handler 24 or otherwise induced by the response personnel or from target X.

Figure 6:
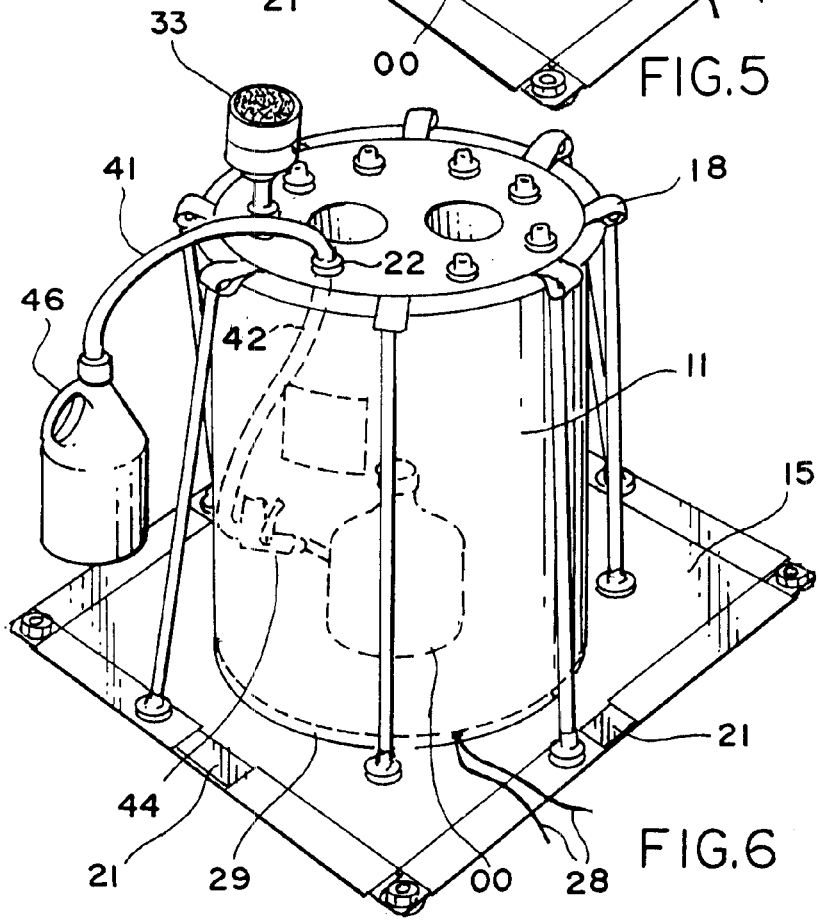
FIG. 6 is a further view of the assembled containment system, a target, in the form of a one gallon bottle, and the decontamination unit.
Figure 7:
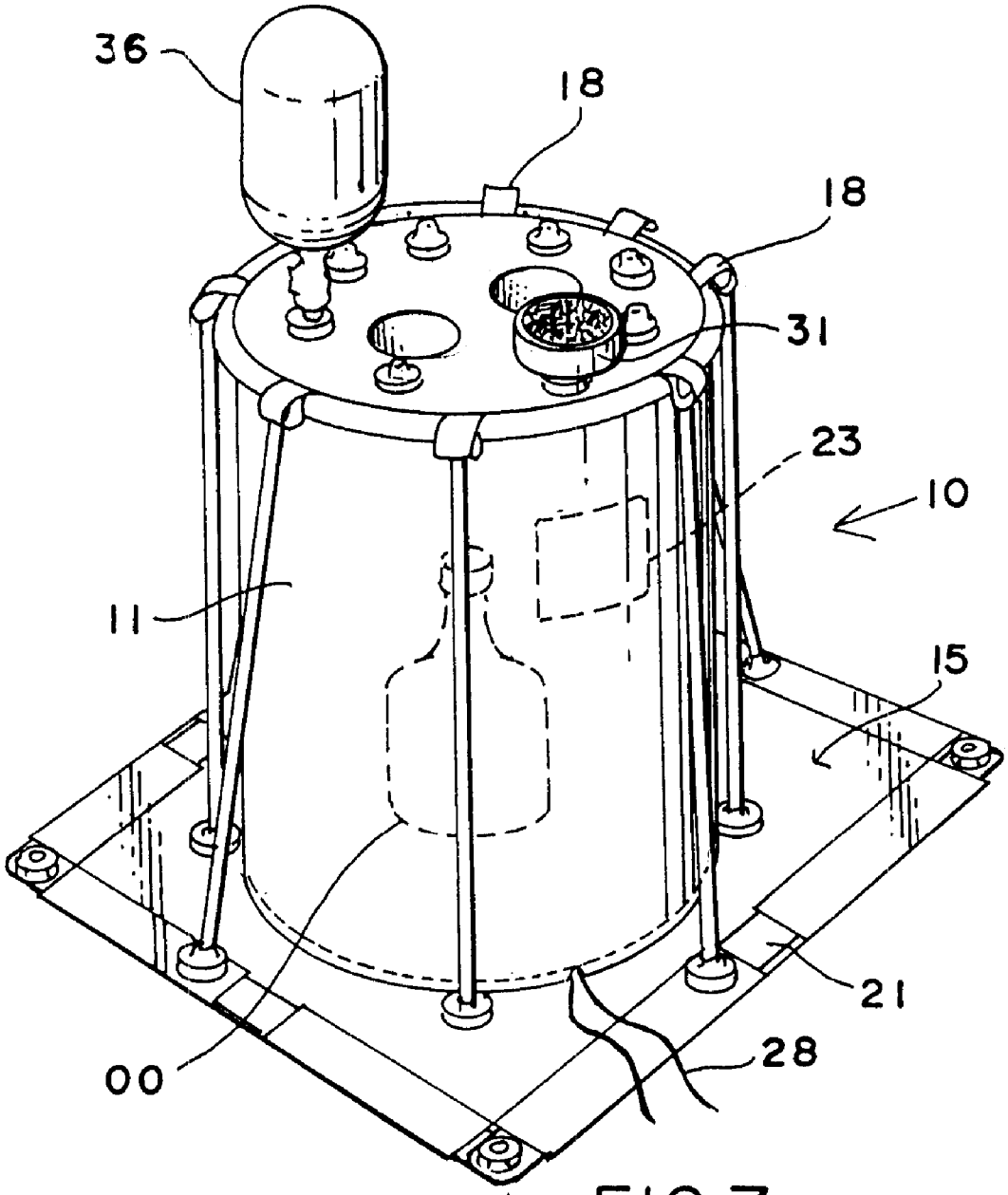
FIG. 7 is a view sequential to that of FIG. 5 illustrating diagrammatically how air can be drawn into the chamber through the filter and withdrawn by a vacuum air sampler.
Figure 8:
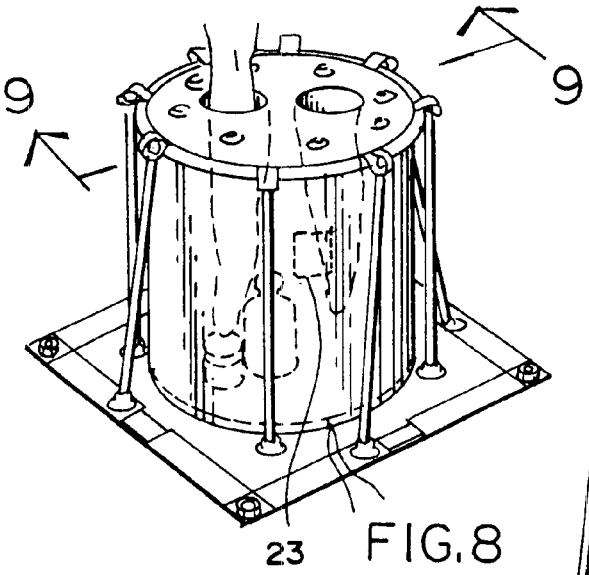
FIGS. 8 through 13 inclusive, show how the handlers can be employed to secure and remove a sample of the target out of the chamber, or alternatively introduce material into the chamber. More particularly.
Figure 9:
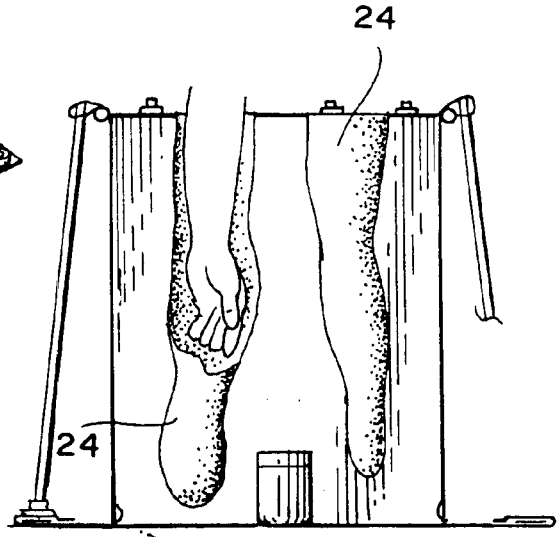
Figure 10:
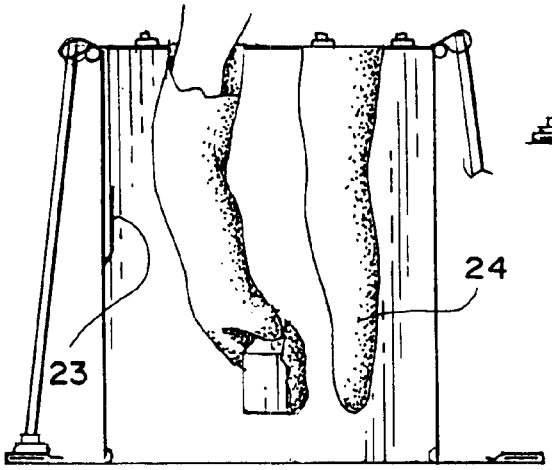
Figure 11:
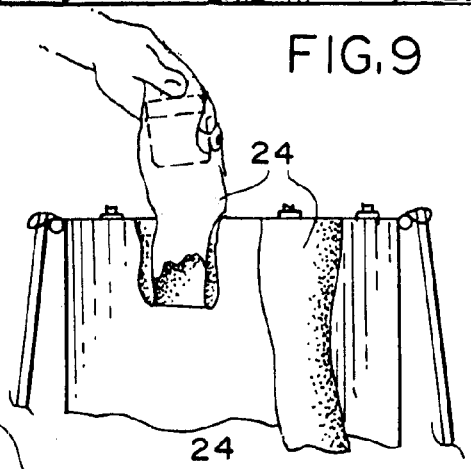
Figure 12:
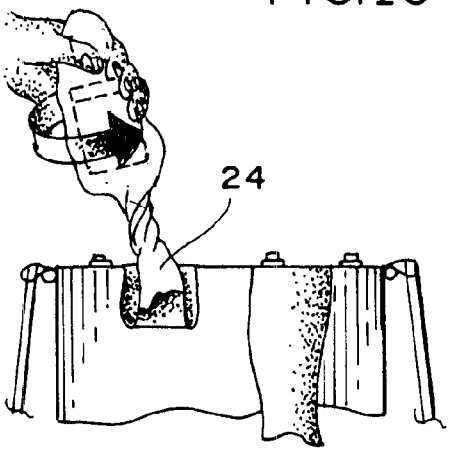
Figure 13:
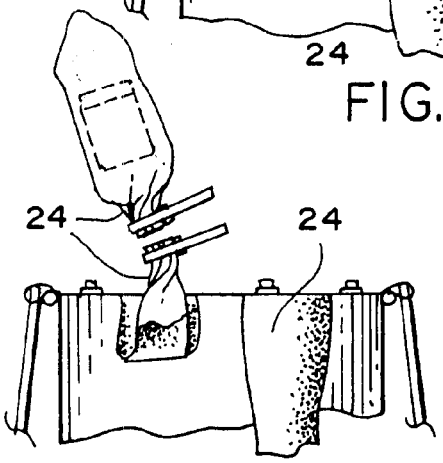

FIG. 6 shows a gas and particulate filter 33 which can also be provided in one of the ports 22 which allows any of the gas contents of the chamber 11 passing outwardly, attributable to the target to be safely discharged. Finally, the ports 22 have sealing means so that inserts for sampling, filtration, decontamination, etc. are sealed upon removal, thereby inhibiting leakage.

In the event decontamination of the target and area is required, it is desirable to decontaminate target X with the decontaminant container 46, as shown in FIG. 6. The decontaminant outer line 41 connects with the decontaminant inner line 42 terminating with the decontaminant spray nozzle 44. After testing, identification, evidence preparation and decontamination, target X can now be prepared for disposal or transport to a laboratory for further analysis or to be used as evidence.

Figure 4:
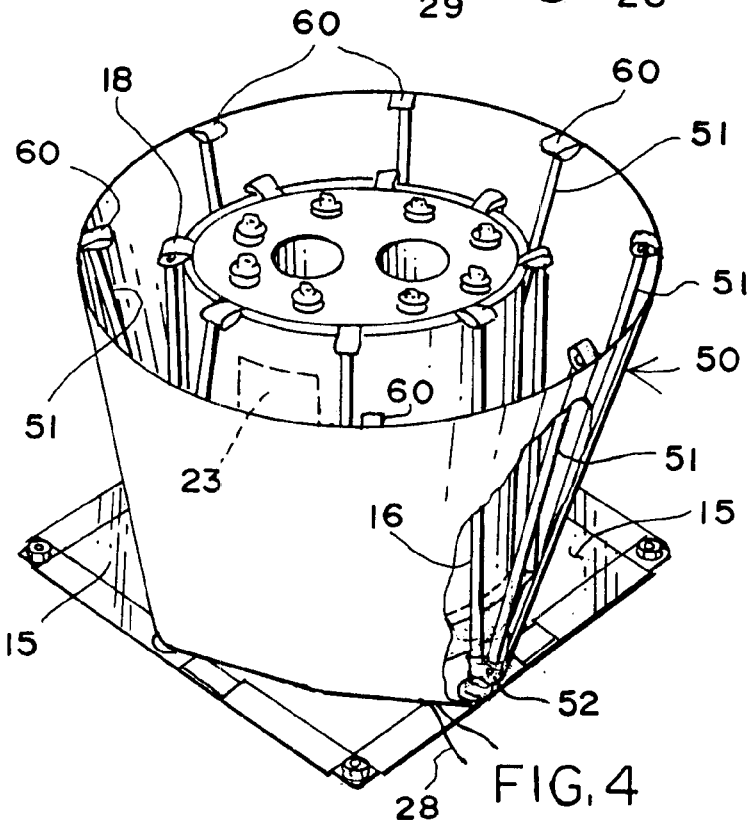
FIG. 4 is an illustration sequential to that of FIG. 3 but illustrating how an explosion shield may be employed.

It should be noted in FIG. 4 that the explosion shield 50 is supported by explosion shield support rods 51, which support rods are secured hingedly at their lower end to the support struts 16 for the chamber itself by explosion rod holders 52. Explosion shield tabs 60 are provided at the upper portion of the explosion shield 50 to receive the explosion shield support rods 51 in the fashion similar to the engagement of the wall support struts 16 in the strut tabs 18 which form chamber 11.

Disassembly of the rapid containment kit 10 is essentially the reverse of the assembly with the exception of the appropriate safeguards to secure the target and also secure the contents of the container against leakage.

Here it must be emphasized that State, Local, and Federal procedures and protocol for the handling of toxic matters, or weapons of mass destruction, must be meticulously followed. Negligence by the responder or handler, at any stage of the use or disassembly, can result in enhancing the contamination of the environment, the disturbance of evidence, or potential harm to people.

If the explosion shield 50 has been deployed, it should be removed before disassembling the chamber 11. Thereafter, wall support struts 16 and flange flatteners 21 are removed. The wall drawstring 28, in drawstring sleeve 29 is drawn, particularly as shown diagrammatically at the lower portion of FIG. 3. As the drawstring 28 is deployed it lengthens the exposed drawstring portion and squeezes the lower portion of the cylindrical wall 12 until such time as the cylindrical wall 12 and its adjacent flange 15 are drawn to the base of the target X to form a closure. During this time when the wall drawstring 28 is applied, a hand inside the handler 24 permits raising the target X so that when the drawstring is totally drawn, the target X is totally encapsulated by the chamber 11.

The disassembly also contemplates stabilizing the target. As struts 16 and the flange flatteners 21 are removed, the chamber 11 is permitted to collapse downwardly while exhausting the containers gas environment through the proper filter or filters. The drawstring 28 is then secured beneath the target as it collapses, unless the situation dictates that the drawstring 28 should be tightened toward the end of the disassembly aspect. As the chamber 11 encloses around the target, the target is manipulated from the outside rather than the inside until the gas from inside the chamber is substantially exhausted. The target and chamber is preferably carried by grasping the target from the outside of the collapsed chamber. The encapsulated target can then be packaged for additional protection during transportation to a second phase area for recovery, further investigation, and retention as an exhibit.

Here it will be appreciated that the filter 31 may be used to evacuate the chamber to prevent the escape of particulates from the chamber as the chamber 11 is being collapsed. If chemical gases are suspected, filter 33 should be used which filters both particulates and gases.

As stated earlier, in a situation where it is anticipated that the target X might be explosive, an explosion shield 50 is employed. The explosion shield 50 is normally frusto conical in configuration and inverted in usage. A plurality of explosion shield support rods 51 are inserted into the explosion rod holders 52. The material for the frusto conical explosion shield 50 is Kevlar® or equivalent, and is tapered in accordance with an angularity generally contemplated to deflect any shrapnel, or other pieces of shattered containment of the explosive member, in an upward direction. While there is no guarantee against shrapnel extending outwardly, at least its momentum will be severely reduced and the kinetic energy absorbed by not only the cylindrical wall 12, but the material of the frusto conical explosion shield 50 as well as the angular disposition of the flying objects.

The subject container 11 from the kit 10 can be converted to a glovebox by the use of a vacuum pump which will induce an interior negative pressure of ½ inch or greater. An inlet HEPA type filter is employed in one of the ports 22 in the top 14 so that the air removed by the vacuum pump will be replaced by HEPA filtered make-up air. Before the outlet and the vacuum pump, a HEPA type filter is similarly employed.

Objects are brought into and removed from the chamber utilizing the handlers and the bag-in and bag-out method, as set forth in the method described above.

THE CONTAINER KIT

Figure 14:
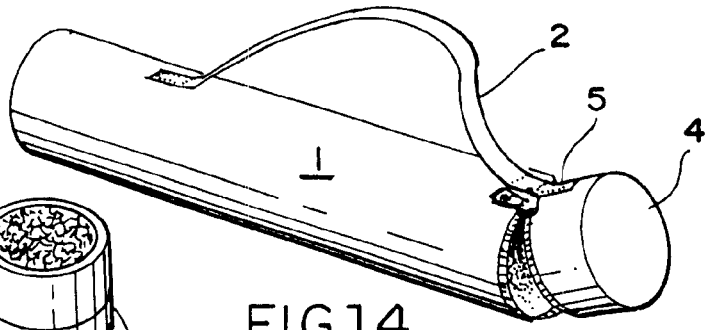
Figure 15:
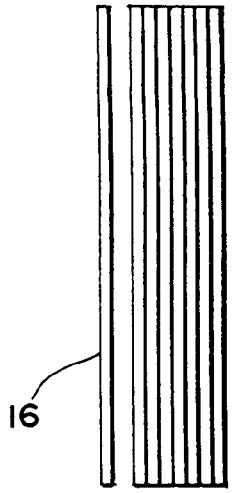

As shown in FIG. 14, the backpack container 1 itself has straps 2, a generally cylindrical body terminating at its top with a flap member 4 held in place by means of securement elements 5. As shown in FIG. 15, the wall support struts 16 are of proper length to fit into backpack 1.

Figure 16:
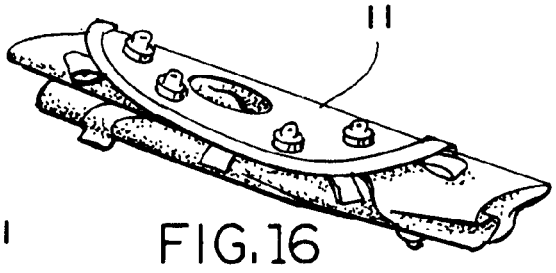

Turning now to FIG. 16, it will be seen that the chamber 11 is in its folded configuration and rolled to fit into the backpack, yet as shown in FIGS. 2 through 7, the chamber 11 is erected. At this time the wall support struts 16 are assembled and inserted into strut tabs 18 at the top and strut footers 19 at the bottom.

Figure 17B:
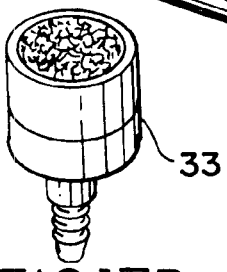
FIG. 17B illustrates a particulate and gas filter.
Figure 17A:
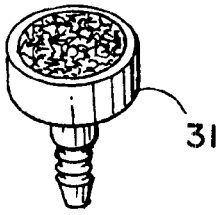
FIG. 17A shows a front elevation of a particulate filter which can be inserted in a port on the top of the chamber.

FIG. 17A illustrates a particulate filter.

FIG. 17B represents a gas and particulate filter.

Figure 18:
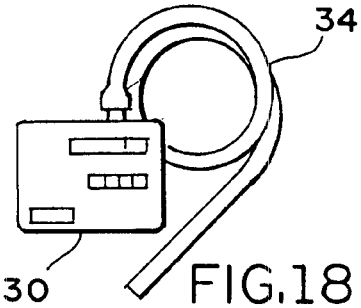

FIG. 18 illustrates one type of sampler showed deployed in FIG. 5 which is inserted for analyzing the environment inside the bag (liquid or gas).

Figure 19:
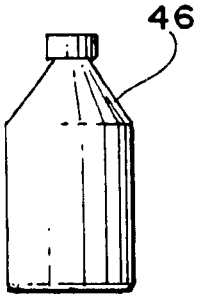
Figure 20:
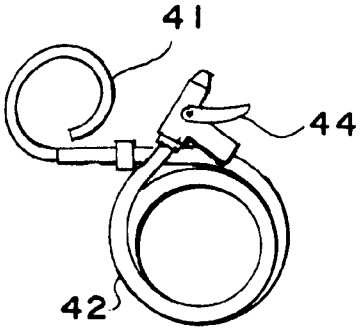

As shown in FIGS. 19 and 20, and illustrated in FIG. 6, the disinfectant, or decontaminant container 46 is secured to the decontamination outer lines 41 and decontamination inner lines 42 for leading the decontaminant to the nozzle 44 from which it is dispensed.

Figure 21:
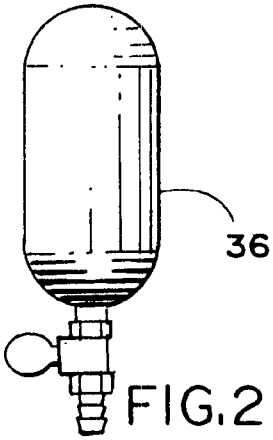

FIG. 21 shows a vacuum air sampler.

Figure 22:
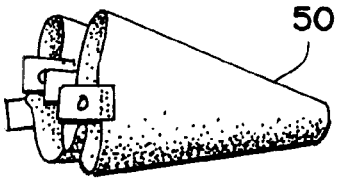

FIG. 22 is the collapsed view of the explosive shield. It is shown fully deployed in FIG. 4.

As shown in FIGS. 3 through 7, utensil pocket 23 will typically be loaded with tie wraps, a cutter, sample collection vial or bottle, and other desirable accessories.

The method of the present invention to be described hereinafter relates to the employment of the members of the kit as just described illustratively with the description of FIGS. 14 through 22.

THE METHOD

While the method of the present invention may be closely tied to the rapid containment kit 10, the sequence is nonetheless important for effective usage. The sequence includes several steps, the first step of which is removing the required kit elements from the backpack 1 and desirably positioning the rapid containment kit 10 on a surface for assembly.

Here again it should be emphasized that at all times in performing the subject method there must a strict adherence to State, Local, and Federal procedures and protocol with regard to weapons of mass destruction, toxic and explosive devices. Failure to follow such procedures can result in serious problems of toxicity, explosion, environmental contamination, the disturbance of evidence, or potential harm to people.

The circular top forming hoop 13 and the circular top 14 give shape to chamber 11. The wall support struts 16 are then inserted in the wall support tabs 18 in order to engage the wall support footers 19 provided on the base flange 15 and/or its flange sleeves 20.

At this point of the method the base flange 15 has the base flange flatteners 21 positioned into the base flange sleeves 20 so that the flange can be secured and sealed to the substrate on which the suspicious object or target X lies, by a duct tape or the like, or by weights such as bricks, or other securing objects found in the area where the target X is located to secure it in place.

Desirably, but not necessarily, the sample reader(s) 30 is installed after the shape of the chamber 11 has been secured. The handler may aid in operation of the sample reader 30 and sampling. In the event it is desirable to decontaminant target X the decontaminant outer line 41 is connected to the decontaminant inner line 42 with its decontaminant sprayer nozzle 44 allowing the decontamination fluid to be drawn from its supply 46. A vacuum air sampler 36 or other samplers may be used. Make up air to replace the air withdrawn by the samplers enters through filter 31.

Chamber 11 can be converted to perform the function of a glovebox by the use of inlet and outlet HEPA particulate filters 31. A vacuum pump is attached to the outlet HEPA filter to produce at least ½ inch negative pressure. If toxic gases are expected, gas and particulate filters 33 should be used. All samplers, filters, decontaminants, and the like, are attached by ports 22 which have sealing means.

After completion of all on-site procedures and, if target X is to be moved, air is removed from the chamber through an appropriate filter. Drawstring 28 is then used to encapsulate target X.

As a precaution, or particularly when an explosive is suspected, prior to covering target X, an explosion shield 50 is employed around the chamber 11 and positioned in place by means of the explosion shield support rods 51, which are shown in FIG. 4.

In conclusion, both an apparatus and method have been disclosed in which rapid containment and securement of a possible target X, which may be a WMD, permits and aids in progressive response levels and functions as appropriate.

It will be understood that various changes in the details, materials and arrangements of parts, or method which have been herein described and illustrated in order to explain the nature of the invention, may be made by those skilled in the art within the principle and scope of the invention as expressed in the appended claims.

What is claimed is:

1. A rapid containment assembly for a suspicious object or target comprising, in combination:

a surrounding collapsible wall member having an upper and lower portion defining an interior chamber;

a top for said interior chamber sealed to the surrounding wall at its upper portion;

a substrate engaging member secured to the lower portion of the surrounding wall and extending therefrom and having means for removably securing the substrate engaging member to a substrate upon which the target is positioned;

a handler in the form of a closed tube secured to the chamber and extending inwardly to the chamber;

support means positioned around the wall of the chamber to thereby rigidify the collapsible chamber; and means at the base of the wall for tightening and closing the chamber to envelop the target.

2. In the rapid containment assembly of claim 1, means for converting the assembly into a portable glovebox comprising, in combination;

a filter for filtering incoming air to the chamber;

a filter for filtering outgoing air from the chamber; and means for applying a vacuum to the filter for filtering to produce a negative pressure in the chamber.

3. In the rapid containment assembly according to claim 1, said handler having a length to thereby permit bag-in and bag-out transfers.

4. In the rapid containment assembly according to claim 1, ports provided on the chamber for the insertion of samplers, filters, and decontaminants as may be indicated in the particular exercise where a target is being processed.

5. An explosion shield for use in the rapid containment assembly according to claim 1, including, an exterior shield of larger cross dimension than the chamber for the containment assembly for positioning in surrounding fashion to the rapid containment assembly and having sidewalls formed of a material to absorb the force of an explosive and inhibit explosive shrapnel or other flying objects from propagating laterally.

6. The method for containing a suspicious object by using a rapid containment assembly which includes a collapsible surrounding wall, a top secured to the surrounding wall and said wall having a substrate engaging portion, comprising the steps of:

securing wall support means on the periphery of the collapsible surrounding wall to extend the wall to form a container for the suspicious object; and providing a handler extending inwardly to the container for processing the suspicious object by following established protocols.

7. In the method according to claim 6, providing for a drawstring assembly at the lower portion of the wall to close the lower portion of the wall to envelop the suspected target.

8. A disassembled rapid containment assembly of a container comprising, in combination:

a surrounding flexible wall member having an upper portion with an upper edge terminating in a flexible top for closing the upper portion of the wall secured in tight relationship to the upper edge of the surrounding wall;

a handler secured to the chamber and sealed thereto;

a substrate engaging means open at a mid portion and secured in surrounding relationship to the base of the container;

support means for securing the chamber.

9. In the disassembled rapid containment assembly according to claim 8, ports secured at various positions on the chamber for the receipt of auxiliary attachments such as samplers, decontaminants, filters, which auxiliary attachments are utilized for insertion into the ports.

* * * * *